US007748187B2

(12) United States Patent
Sensenig

(10) Patent No.: US 7,748,187 B2
(45) Date of Patent: Jul. 6, 2010

(54) BRACKET FOR JOINING SPANNING MEMBERS

(76) Inventor: W. Glenn Sensenig, 1042 Glen View Dr., P.O. Box 262, Denver, PA (US) 17517

( * ) Notice: Subject to any disclaimer, the term of this patent is extended or adjusted under 35 U.S.C. 154(b) by 727 days.

(21) Appl. No.: 11/501,768

(22) Filed: Aug. 10, 2006

(65) Prior Publication Data

US 2008/0034703 A1 Feb. 14, 2008

(51) Int. Cl.
*E04F 15/00* (2006.01)

(52) U.S. Cl. ..... 52/489.1; 52/480; 52/582.1; 52/799.11; 52/799.14; 52/718.04; 52/800.1

(58) Field of Classification Search . 52/799.11–799.14, 52/677, 506.01, 506.03, 506.04, 506.08, 52/506.1, 718.04, 800.1, 800.11, 800.12, 52/800.15, 800.17, 801.11, 480, 489.1, 582.1
See application file for complete search history.

(56) References Cited

U.S. PATENT DOCUMENTS

| | | | | | |
|---|---|---|---|---|---|
| 3,187,389 | A | | 6/1965 | Anderson | |
| 3,308,590 | A | | 3/1967 | Ettore et al. | |
| 3,334,461 | A | * | 8/1967 | York | 52/317 |
| 3,778,952 | A | * | 12/1973 | Soucy | 52/667 |
| 4,117,644 | A | | 10/1978 | Weinar | |
| 4,221,095 | A | | 9/1980 | Weinar | |
| 4,281,494 | A | | 8/1981 | Weinar | |
| 4,296,580 | A | | 10/1981 | Weinar | |
| 4,333,286 | A | | 6/1982 | Weinar | |
| 4,448,007 | A | | 5/1984 | Adams | |
| 4,498,272 | A | | 2/1985 | Adams | |
| 4,620,403 | A | | 11/1986 | Field | |
| 4,831,808 | A | | 5/1989 | Wynar | |
| 4,844,651 | A | | 7/1989 | Partridge | |
| 4,965,980 | A | | 10/1990 | Leavens | |
| 5,027,573 | A | * | 7/1991 | Commins et al. | 52/489.2 |
| 5,519,976 | A | | 5/1996 | Gee | |
| 5,802,791 | A | | 9/1998 | Kuntz | |
| 6,393,794 | B1 | * | 5/2002 | Pellock | 52/696 |
| 6,446,409 | B1 | | 9/2002 | Emerson | |
| 7,010,894 | B1 | * | 3/2006 | Cappelle | 52/480 |
| 2002/0095897 | A1 | | 7/2002 | Summerford | |

OTHER PUBLICATIONS

PCT International Search Report and the Written Opinion in International App. No. PCT/US07/17548 ( 8 pp.).

* cited by examiner

*Primary Examiner*—Jeanette Chapman
(74) *Attorney, Agent, or Firm*—Dinesh Agarwal, P.C.

(57) ABSTRACT

A bracket for joining at least two spanning members, such as a board and a supporting member, includes a generally planar unitary body having front and rear sections, and a mid-section. The front and rear sections include locking members, which interlock when two brackets are aligned to each other. The bracket allows building of a structure, such as a deck, from top, where the nail or screw heads are hidden.

24 Claims, 9 Drawing Sheets

BRACKET FOR JOINING SPANNING MEMBERS

FIELD AND BACKGROUND OF THE INVENTION

The present invention is generally directed to structural construction, and more particularly to a bracket for joining two spanning members, such as in the construction of a wooden deck.

It is common in wood construction to join one or more spaced supporting members, such as beams or joists, with transversely or crosswise oriented elongated members, such as boards, planks, or slats. In particular, when building decks, boardwalks, stair systems, benches, bleachers, tables, fences, and other similar structures, it is common to first provide a series of spaced apart supporting members which are then covered by crosswise laid elongated members. The supporting members are fastened to the elongated members by nails, screws, or similar mechanical fasteners. However, the nail or screw heads, which can sometimes be rather large, remain visible and in the long term rust and tend to pop up creating an hazardous condition.

Various brackets, clips, fasteners and the like are disclosed in U.S. Patents/Publications U.S. Pat. Nos. 3,308,590; 4,117,644; 4,221,095; 4,281,494; 4,296,580; 4,333,286; 4,448,007; 4,498,272; 4,620,403; 4,831,808; 4,844,651; 4,965,980; 5,027,573; 6,446,409; and 2002/0095897 A1. However, the conventional bracket, clips, etc. are not fully effective and do not properly interlock the members.

OBJECTS AND BRIEF SUMMARY OF THE INVENTION

One object of the present invention is to provide a bracket for joining two spanning members which is simple in construction, easy to use and relatively inexpensive to manufacture.

Another object of the present invention is to provide a bracket for joining two spanning members wherein the nails, screws or other mechanical fasteners used are hidden and do not create a safety hazard.

Another object of the present invention is to provide a bracket for joining spanning members wherein the nails or screw heads create an air gap between, for example, an underlying supporting member and an overlying board, for circulating air therebetween. This configuration prevents or significantly reduces water, ice or snow accumulation by keeping the area dry. As a result, there is no or significantly reduced adverse impact on the supporting members or the boards that may cause shrinking, warping, etc., which could weaken the overall structure.

Another object of the present invention is to provide a bracket for joining spanning members wherein laying of the boards on the underlying supporting members is accomplished from the top side eliminating the need to work from underneath or upside down, or from bottom-up.

Another object of the present invention is to provide a bracket which can be used to build a structure, such as a deck, wherein the nail or screw heads are hidden.

In summary, the main object of the present invention is to provide a bracket which can be used to join at least two spanning members, such as a supporting member and a crosswise running board, to produce a sturdy structure which does not show the nail or screw heads. The bracket is simple in design, relatively inexpensive to manufacture and easy to use.

At least one of the above objects is met, in part, by the present invention which in one aspect includes a bracket for joining at least two spanning members, including a generally planar unitary body including first and second end sections, and a mid-section, and first and second locking members, wherein the first locking member of one bracket interlocks with the second locking member of an adjacent second bracket.

Another aspect of the present invention includes a bracket for joining a plurality of spanning members to at least one supporting member running generally crosswise to at least one spanning member, including a generally planar unitary body including front and rear sections, and a mid-section. The front section includes at least one shoulder section, and the rear section includes at least one cut-out section. The mid-section is for attaching to a spanning member and the front section is for attaching to a supporting member. When two spanning members are placed adjacent to each other, the cut-out section of a bracket attached to one spanning member, interlocks with the shoulder section of another bracket attached to the adjacent spanning member.

Another aspect of the present invention includes an assembled structure, including a plurality of spanning members arranged in succession and joined by a plurality of brackets to at least one supporting member running generally crosswise to at least one spanning member. Each of the spanning members includes upper and lower, and front and rear surfaces, and the supporting member includes upper and lower, and left and right surfaces. Each of the brackets includes front and rear sections and a mid-section. Each of the spanning members includes at least one bracket attached to the lower surface thereof in a manner that the front section thereof is adjacent the rear surface of the succeeding spanning member. The brackets are generally axially oriented along the length of the supporting member, and the rear section of one bracket engages the front section of the preceding bracket.

Another aspect of the present invention includes a method of joining a plurality of spanning members to at least one supporting member running generally crosswise to at least one spanning member, including providing a plurality of brackets, each bracket including i) a generally planar unitary body including front and rear sections and a mid-section, and ii) the front and rear sections including first and second locking members; providing a plurality of spanning members, each including upper and lower, and front and rear surfaces; providing at least one supporting member including upper and lower, and left and right surfaces; attaching a first bracket to a first spanning member on the bottom surface thereof in a manner that the front section of the first bracket is adjacent the front surface thereof; attaching a second bracket to a second spanning member on the bottom surface thereof in a manner that the front section of the second bracket is adjacent the front surface thereof; placing the first spanning member generally crosswise relative to the supporting member and attaching the front section of the first bracket to the supporting member; placing the second spanning member generally crosswise relative to the supporting member and ahead of the first spanning member; and interlocking the first locking member of the first bracket with the second locking member of the second bracket.

BRIEF DESCRIPTION OF THE DRAWINGS

At least one of the above and other objects, novel features and advantages of the present invention will become apparent from the following detailed description of the preferred embodiment(s) of the invention, as illustrated in the drawings, in which.

DETAILED DESCRIPTION OF THE PREFERRED EMBODIMENT(S) OF THE INVENTION

Figure 1:
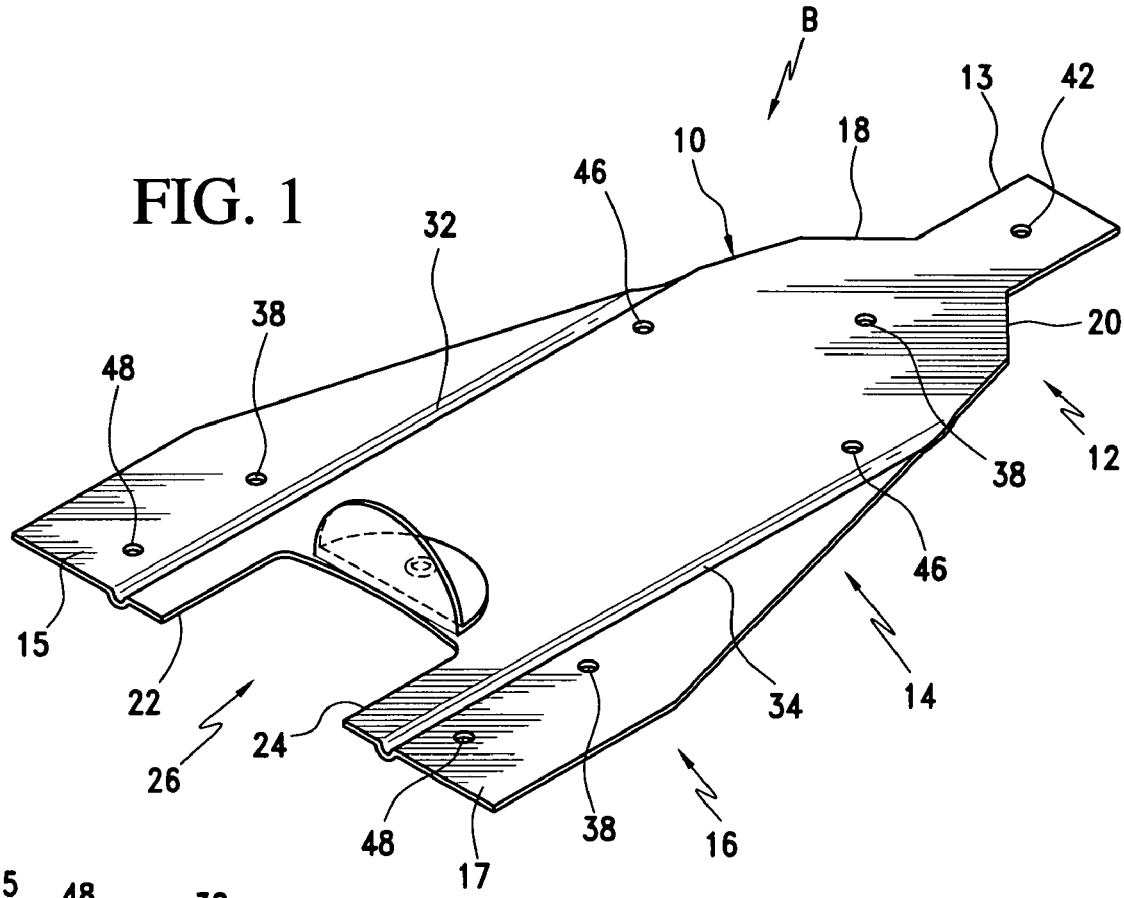
FIG. 1 is a perspective view of a bracket in accordance with the present invention.
Figure 2:
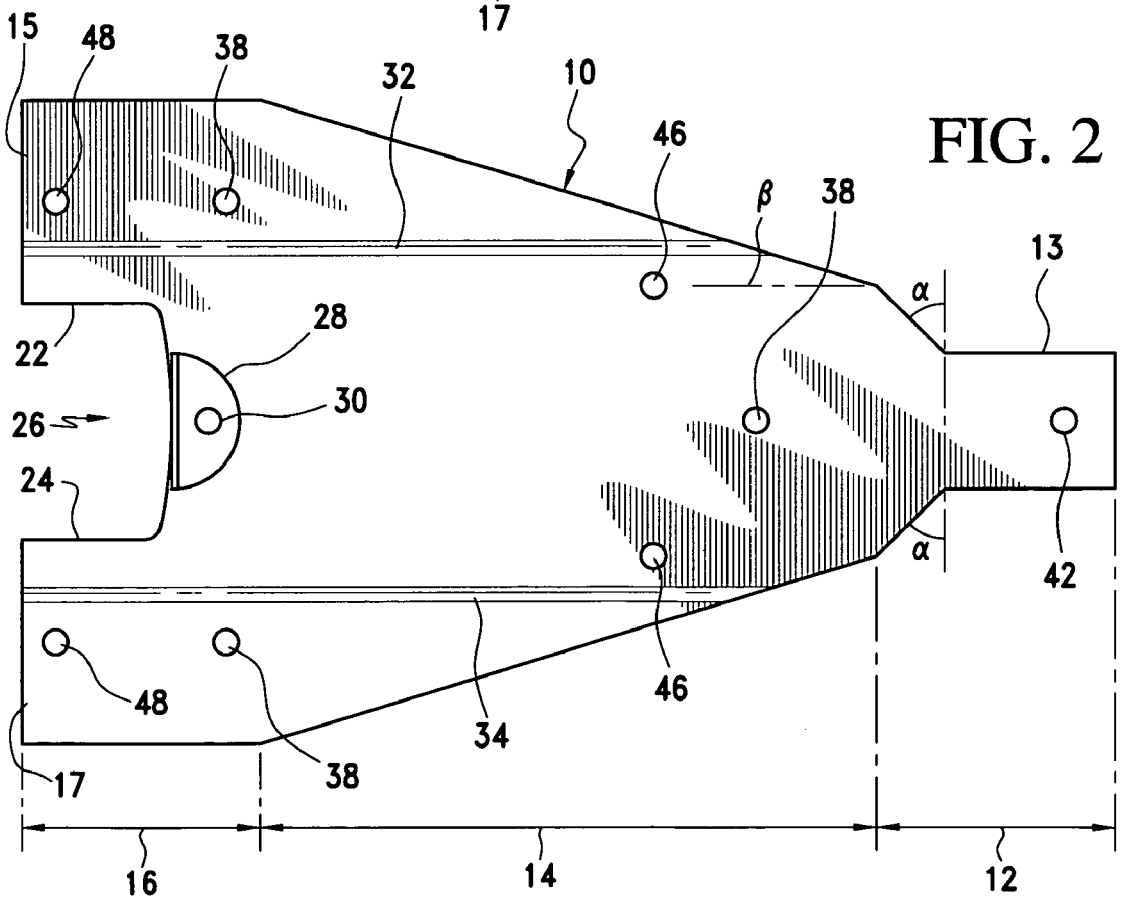
FIG. 2 is a top plan view of the bracket shown in FIG. 1.

Referring now to FIGS. 1-2, the bracket B of the present invention is preferably in the form of a generally planar unitary body 10 including front, mid- and rear sections 12, 14 and 16, respectively. The front section 12 includes left and right shoulder sections 18 and 20, which extend at an angle $\alpha$ towards the mid-section 14 (FIG. 2). Preferably, the angle $\alpha$ is about 30-60°, and more preferably about 45°. The rear section 16 includes left and right tail sections 15 and 17 with cut-out sections 22 and 24, which together form a generally C-shaped cut-out 26. The angled shoulder sections 18 and 20 facilitate easy interlocking with the cut-out sections 22 and 24. Preferably, the mid-section 14 extends towards the rear section 16 at an angle $\beta$ of about 5-60°, and more preferably at an angle of about 18°.

Figure 5:
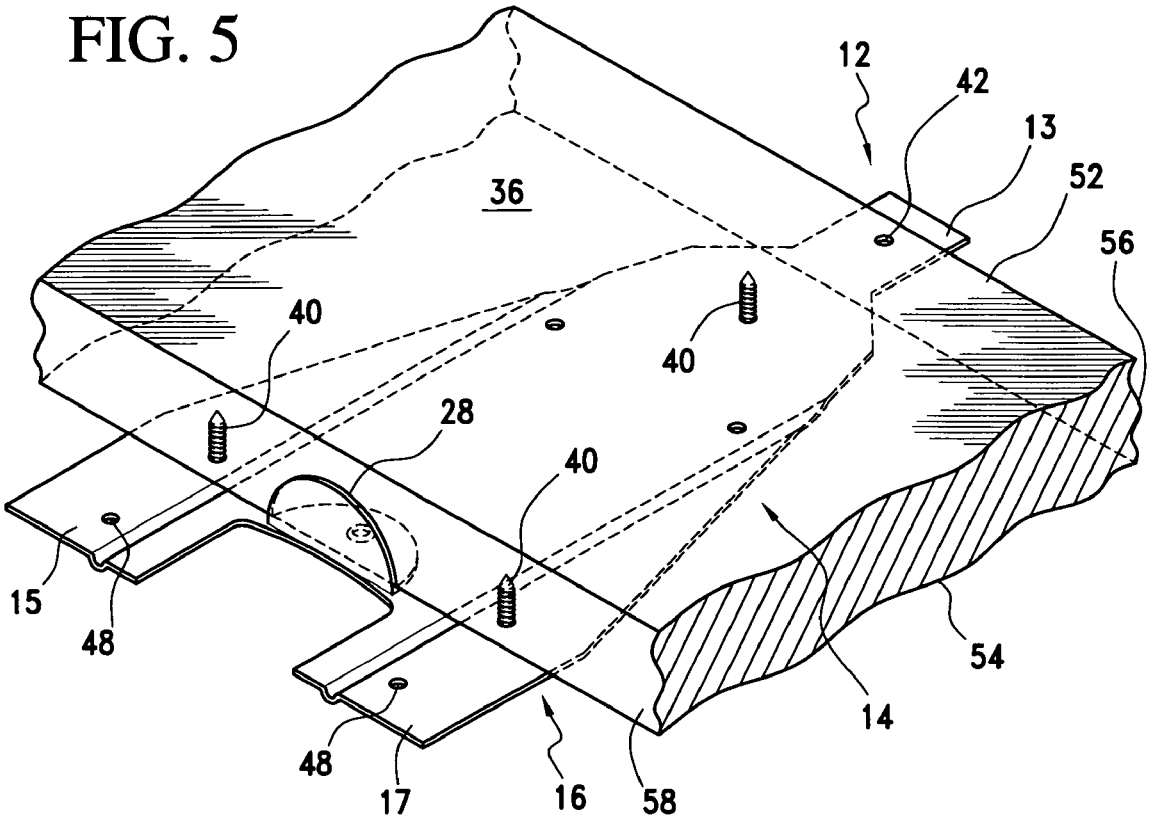
FIG. 5 is a perspective view showing the bracket attached to a board.

A generally L-shaped guide 28 is mounted by a rivet 30 in the rear section 16. The guide 28 swivels about the rivet 30 for guiding and aligning a spanning member, such as a board, transversely or crosswise about the mid-section 14 (FIG. 5).

Although not necessary, preferably two generally parallel, stamped-in, reinforcing ribs 32 and 34 extend from adjacent the front section 12 to the end of the rear section 16. (It is noted herewith that the total number, shape, orientation and overall configuration of the ribs may be varied, as desired. For example, the ribs may crisscross or intersect each other to provide a diamond-like or other pattern on the bracket.)

The bracket B is preferably fabricated from a variety of durable metal material, such as steel, brass, copper, or aluminum. The bracket may also be fabricated from a variety of thermoplastic or thermosynthetic resins materials, such as fiber-reinforced phenolics, glass fiber, reinforced nylon, or polypropylene. The manufacturing of the bracket can be by stamping, bending, casting, machining, welding, molding or other such techniques commonly available to those skilled in the pertinent art. Preferably, the bracket B of the invention is fabricated from a 20-25 mil thick galvanized steel. More preferably, the bracket B is fabricated from a 22 mil galvanized steel. The bracket B may be treated, painted or plated for ornamental reasons and/or to resist adverse weather conditions.

Figure 3:
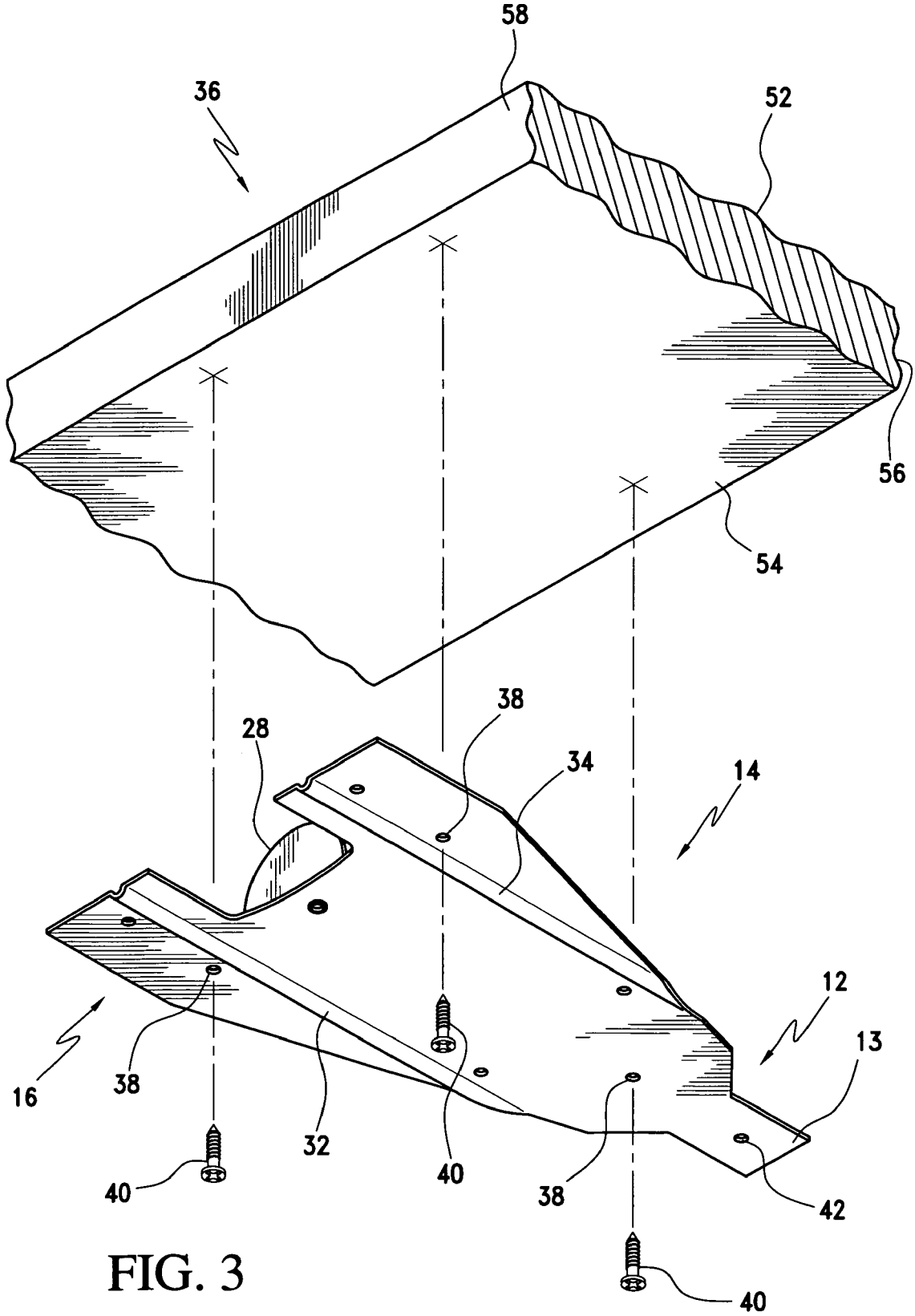
FIG. 3 illustrates attaching of a bracket to the underside of a board.
Figure 4:
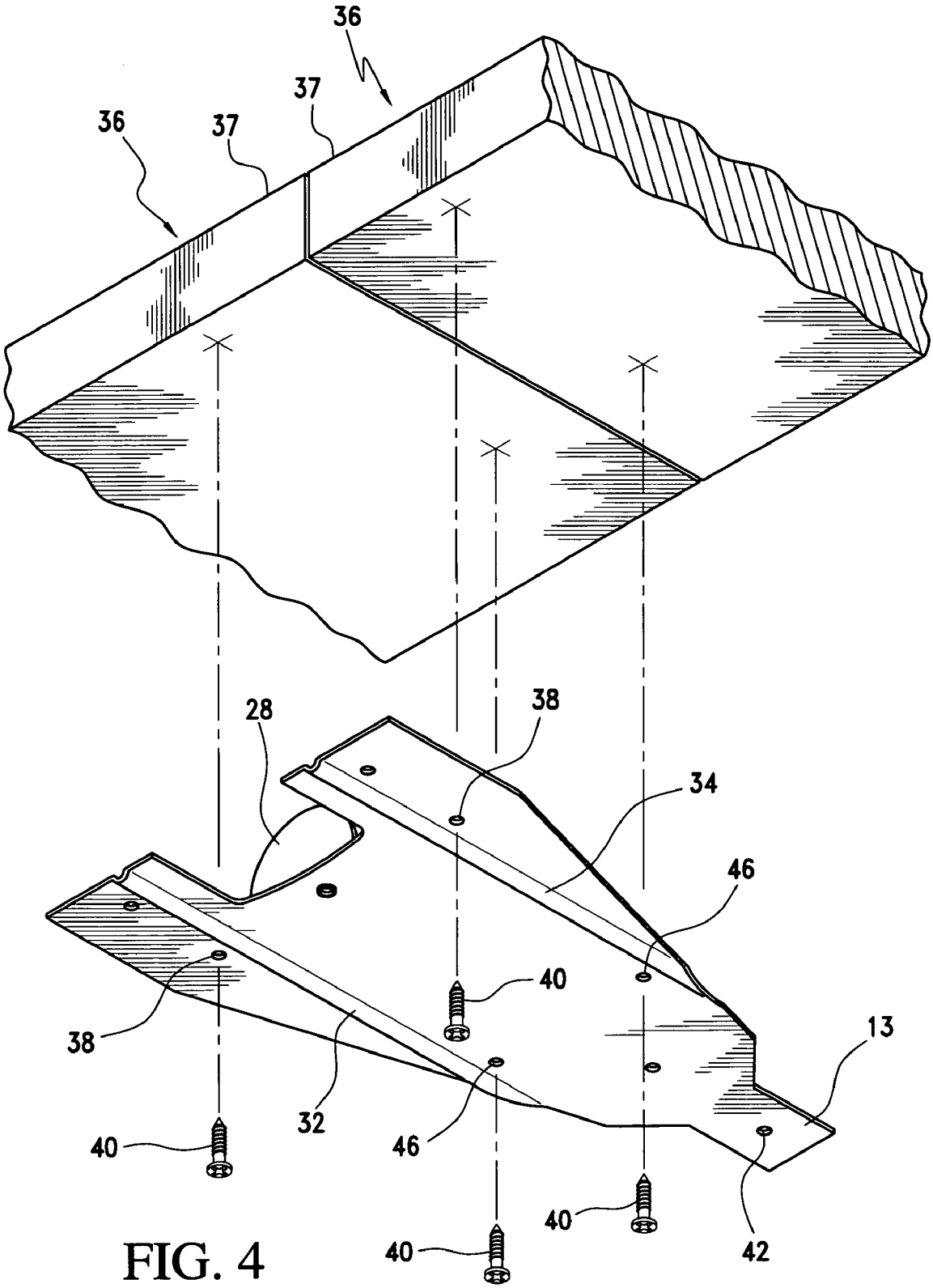
FIG. 4 is a view similar to FIG. 3, showing attaching of a bracket to two end-to-end boards.
Figure 8:
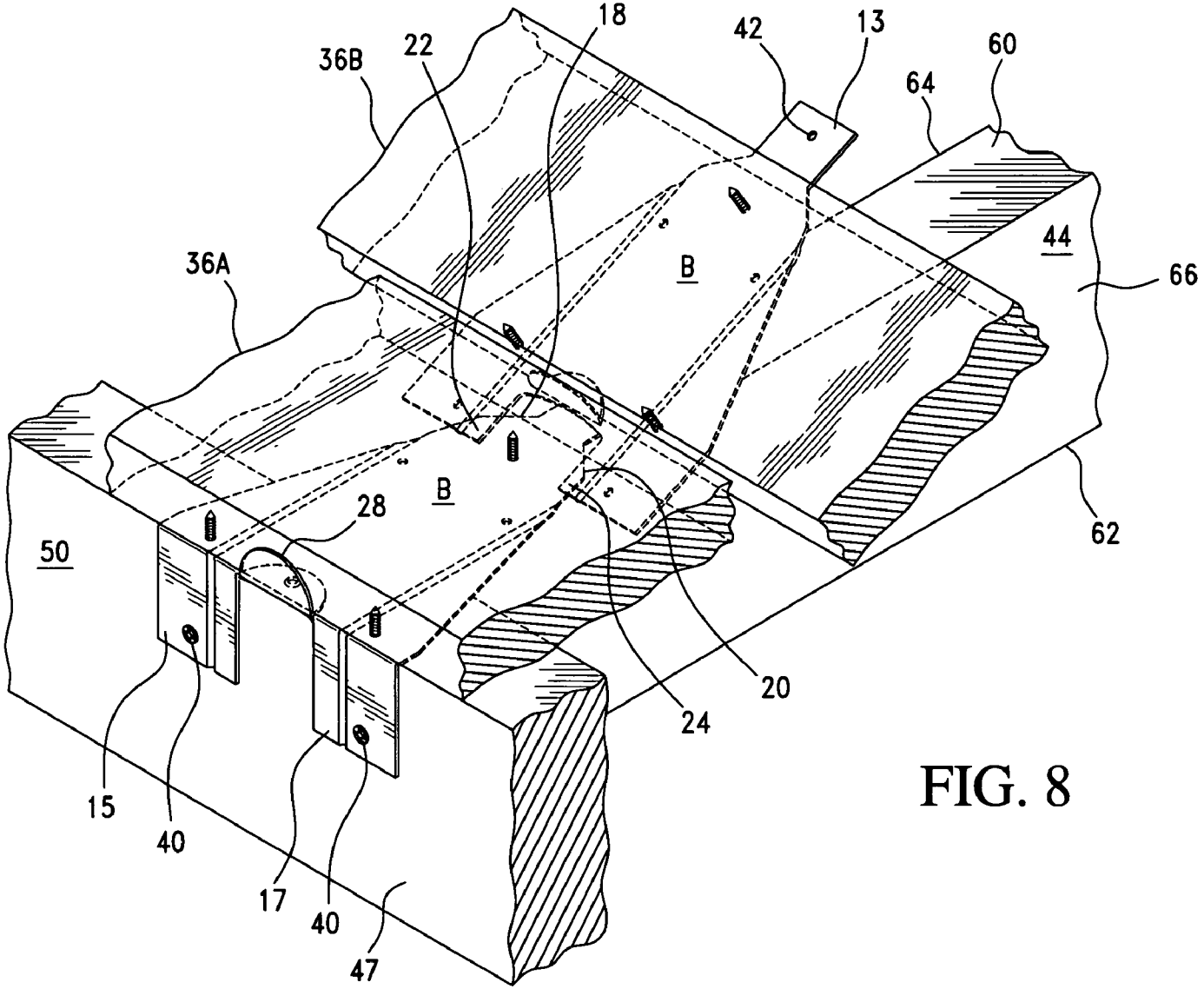
FIG. 8 illustrates placing a second board, similar to the first board shown in FIG. 7, adjacent the first board on the underlying supporting member and interlocking the brackets together.

In order to attach the bracket B to a spanning member, such as a board 36 (FIG. 3), the mid-section 14 includes, preferably one front and two back holes 38 arranged in a triangle. Conventional nails or screws 40 may be driven through the holes 38 to attach the bracket B to, for example, the underside or lower surface 54 of the board 36. A nose hole 42 is provided in the nose section 13 for attaching the bracket B to, for example, another spanning member, such as a supporting joist 44 (FIG. 8). The mid-section 14 further includes two laterally spaced front holes 46, which are used when the bracket B is attached to two spanning members in an end-to-end relationship (FIG. 4). Two tail holes 48 in the tail sections 15 and 17 serve to attach the bracket B to an end supporting member 50 by bending the tails 15 and 17 and driving screws 40 through the holes 48 (FIGS. 2 and 8).

Use and Operation

Figure 6:
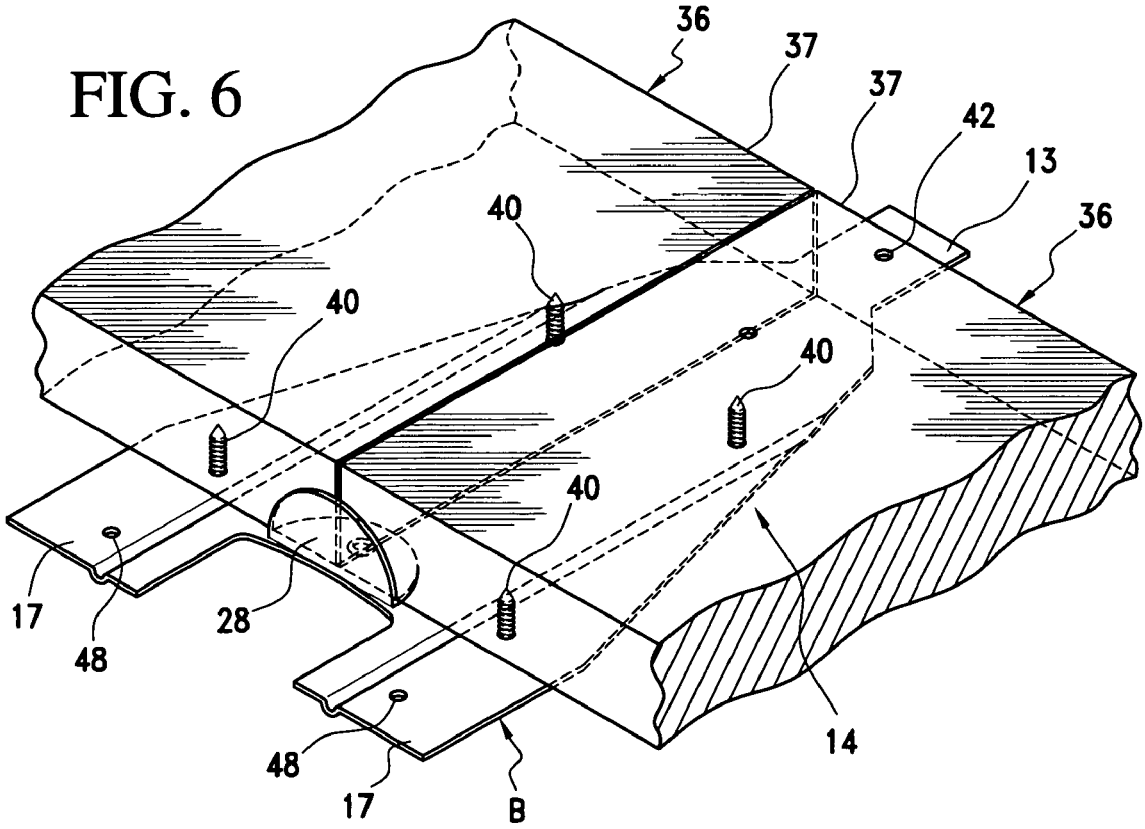
FIG. 6 is a perspective view showing the bracket attached to two adjacent end-to-end boards.
Figure 7:
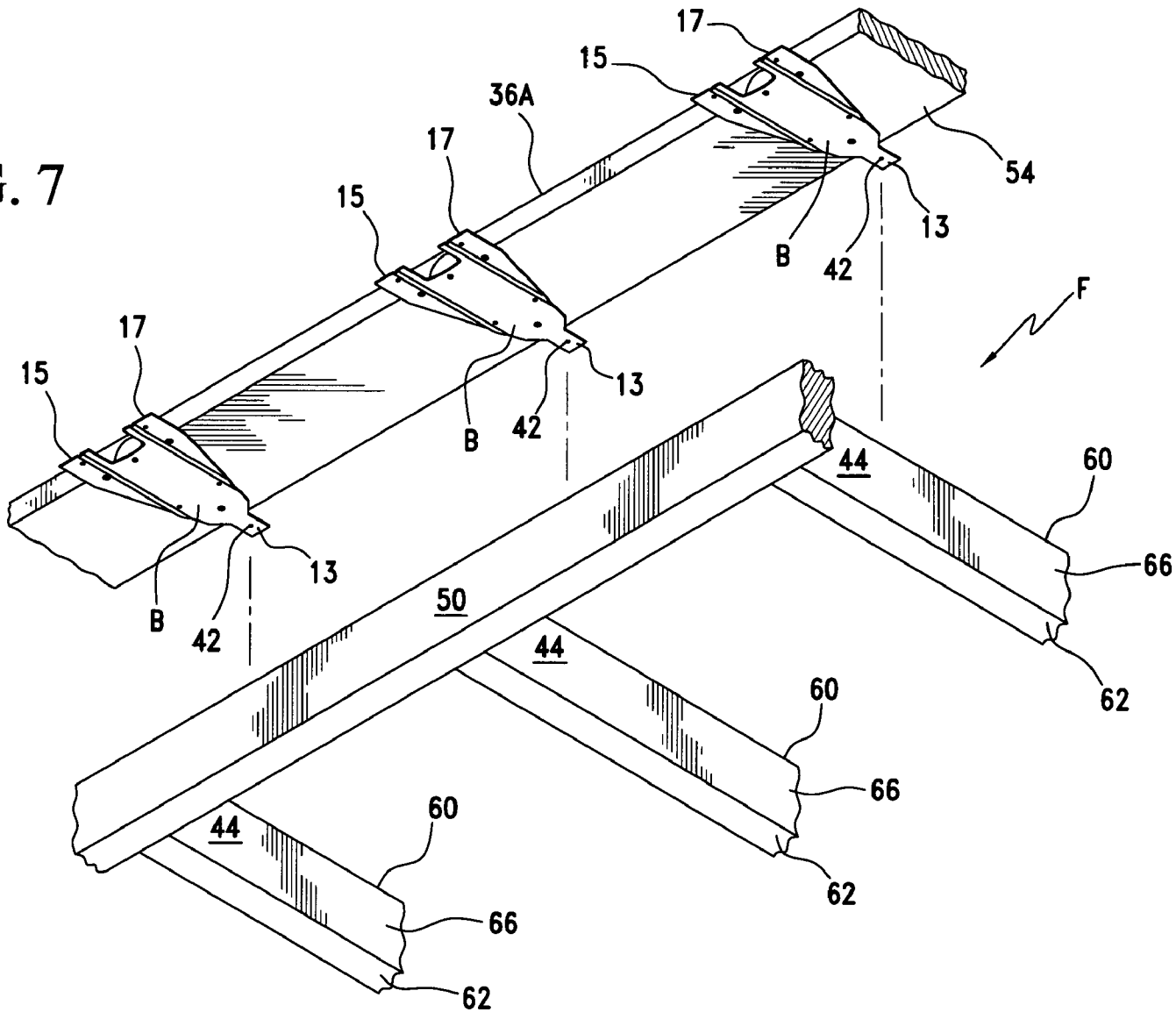
FIG. 7 illustrates placing of a first board with multiple brackets attached thereto onto crosswise running supporting members.

The use and operation of the bracket B of the present invention for building a structure, such as a deck, will now be described. Although a spanning member, such as a board or a supporting member like a joist, each typically would have four sides, for the ease of illustration, it is noted herewith that each board 36 includes upper and lower surfaces 52 and 54, and front and rear surfaces 56 and 58 (FIGS. 3 and 5). Likewise, each supporting member 44 includes upper and lower surfaces 60 and 62, and left and right surfaces 64 and 66 (FIGS. 7-8). (It is noted herewith that the boards 36 shown in FIGS. 4 and 6, are the same as the boards shown in FIGS. 3 and 5, except that they are shown arranged end-to-end relative to the mid-section 14 of the bracket B.)

In order to build a deck, typically a base or supporting frame F comprised of generally parallel running supporting members or joists 44 joined to end supporting members 50, is provided. (It is noted herewith that since only a portion of the frame F is shown in FIGS. 7-11, only one end supporting member 50 is shown).

Although all of the boards 36 are the same, for the ease of illustration, the five boards placed in succession over the underlying supporting members 44, shown in FIGS. 7-12, have been designated as 36A, 36B, 36C, 36D and 36E, indicating the order of their placement.

As noted above and shown in FIGS. 3 and 7, multiple brackets B are attached to the lower surface 54 of a first board 36A, by driving the screws 40 through the corresponding three front and back holes 38 in each bracket B. As best shown in FIG. 7, the brackets B are laterally spaced in correspondence with the laterally spaced supporting members 44.

As best shown in FIG. 5, each bracket B is mounted in a manner that the front section 12 thereof is adjacent the front surface 56 of the board, and the rear section 16 is adjacent the rear surface 58 thereof. As can be easily seen from FIG. 5, the bracket B is longer than the width of the board 36. Thus, the nose section 13 of the bracket B extends past the front surface 56, and the tail sections 15 and 17 thereof extend past the rear surface 58. The guide 28 is used to align the board 36 on the mid-section 14.

Figure 9:
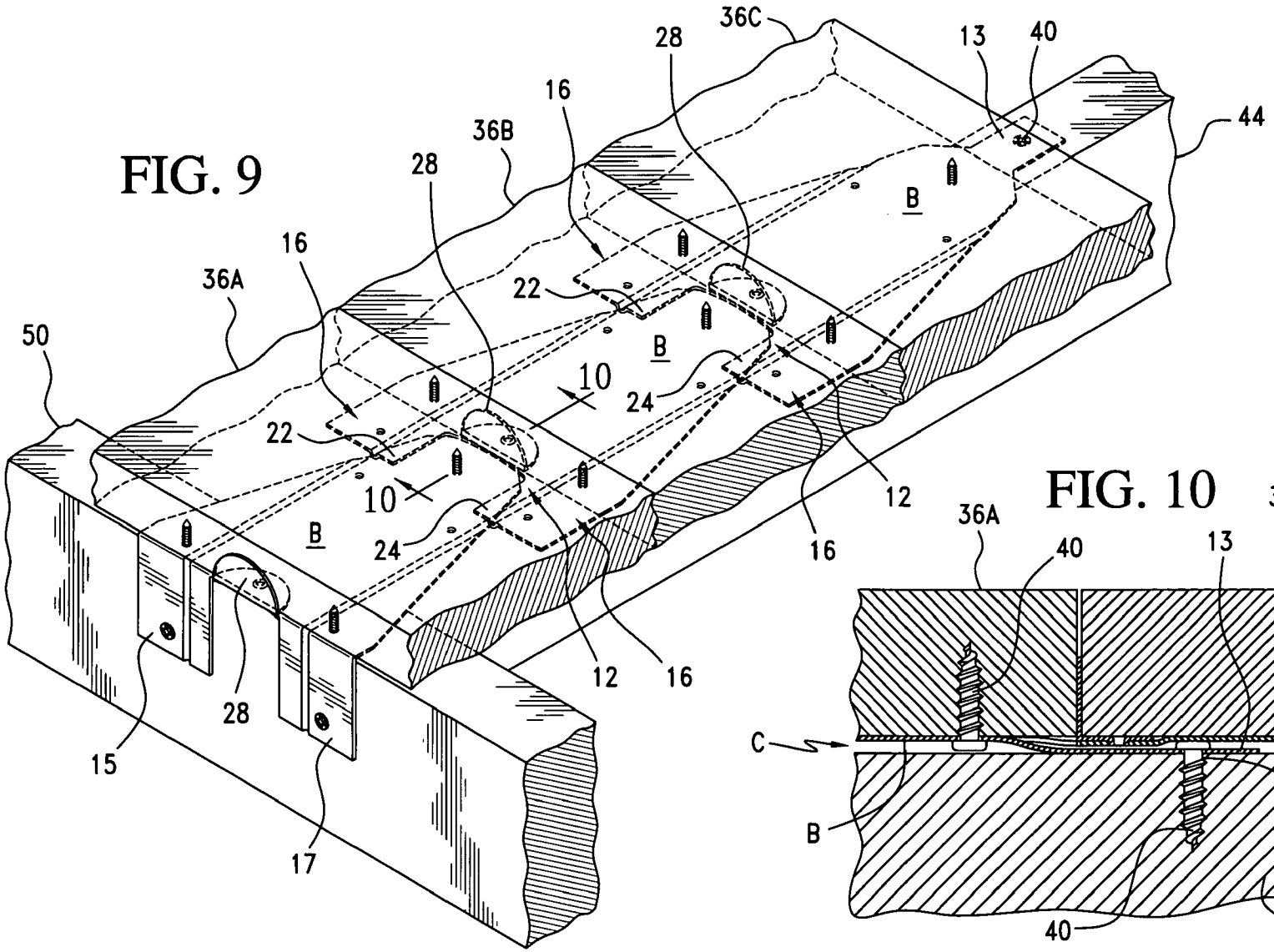
FIG. 9 illustrates three boards attached to an underlying supporting member by interlocking brackets therebetween.
Figure 10:
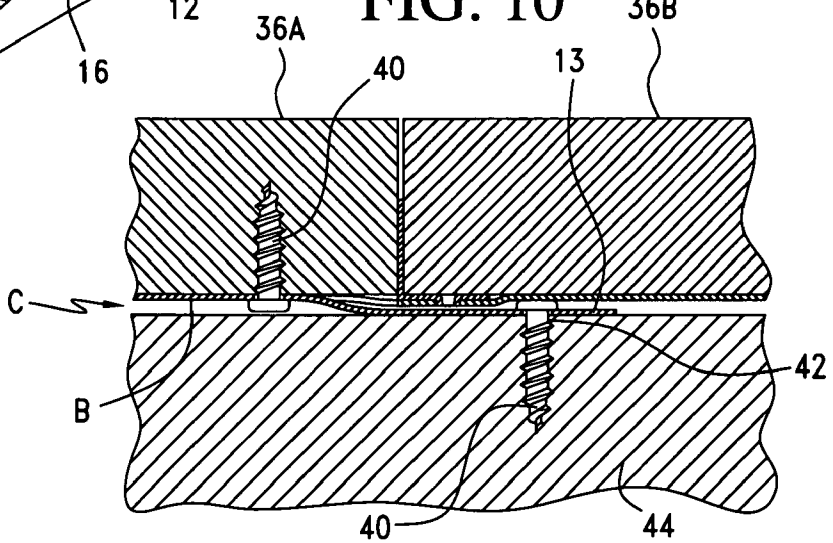
FIG. 10 is an enlarged sectional view taken along line 10-10 of FIG. 9, showing an air gap between the boards and the underlying supporting member.
Figure 11:
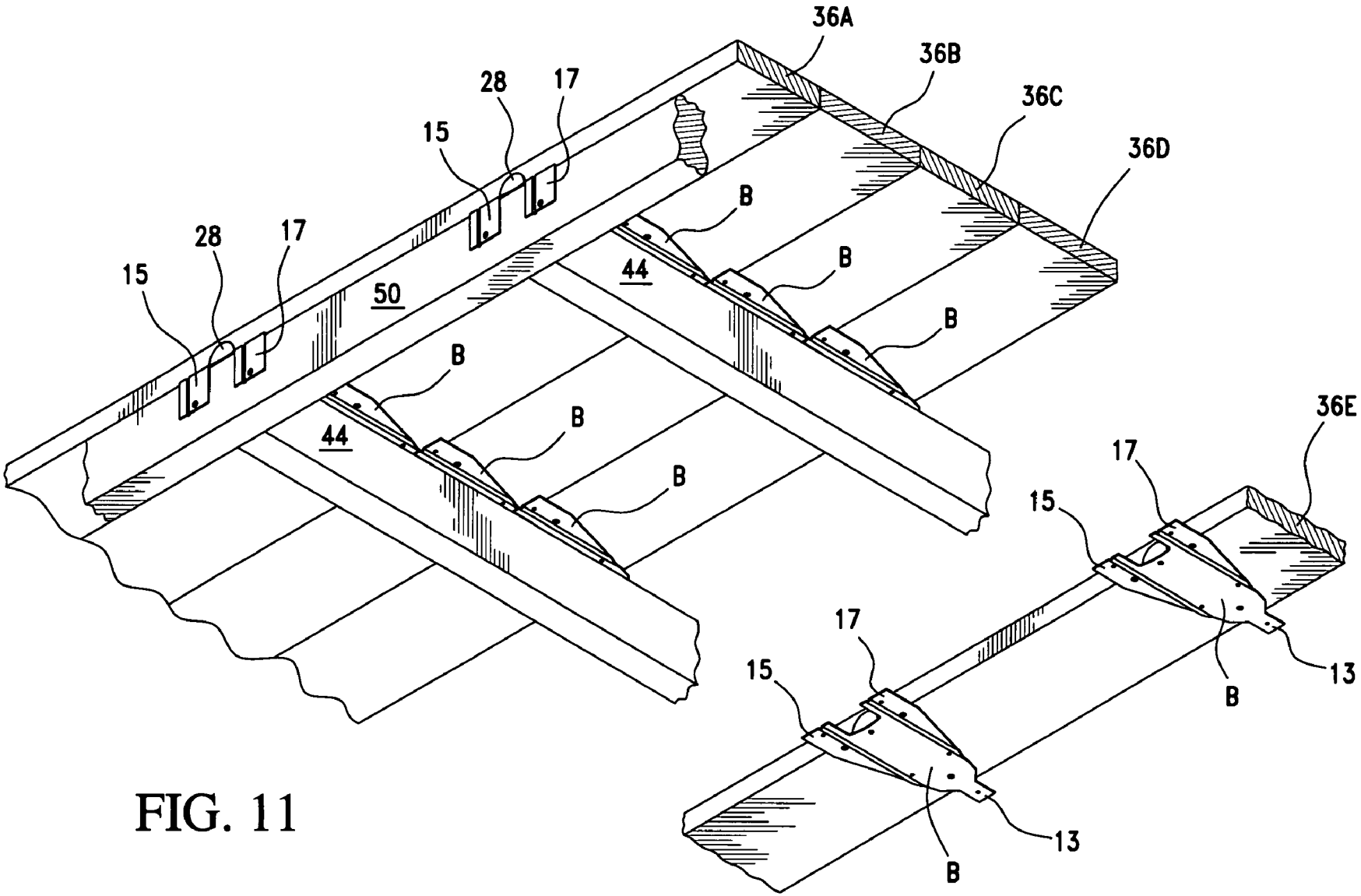
FIG. 11 is a bottom perspective view of the assembly of FIG. 9, showing a partially completed deck structure.
Figure 12:
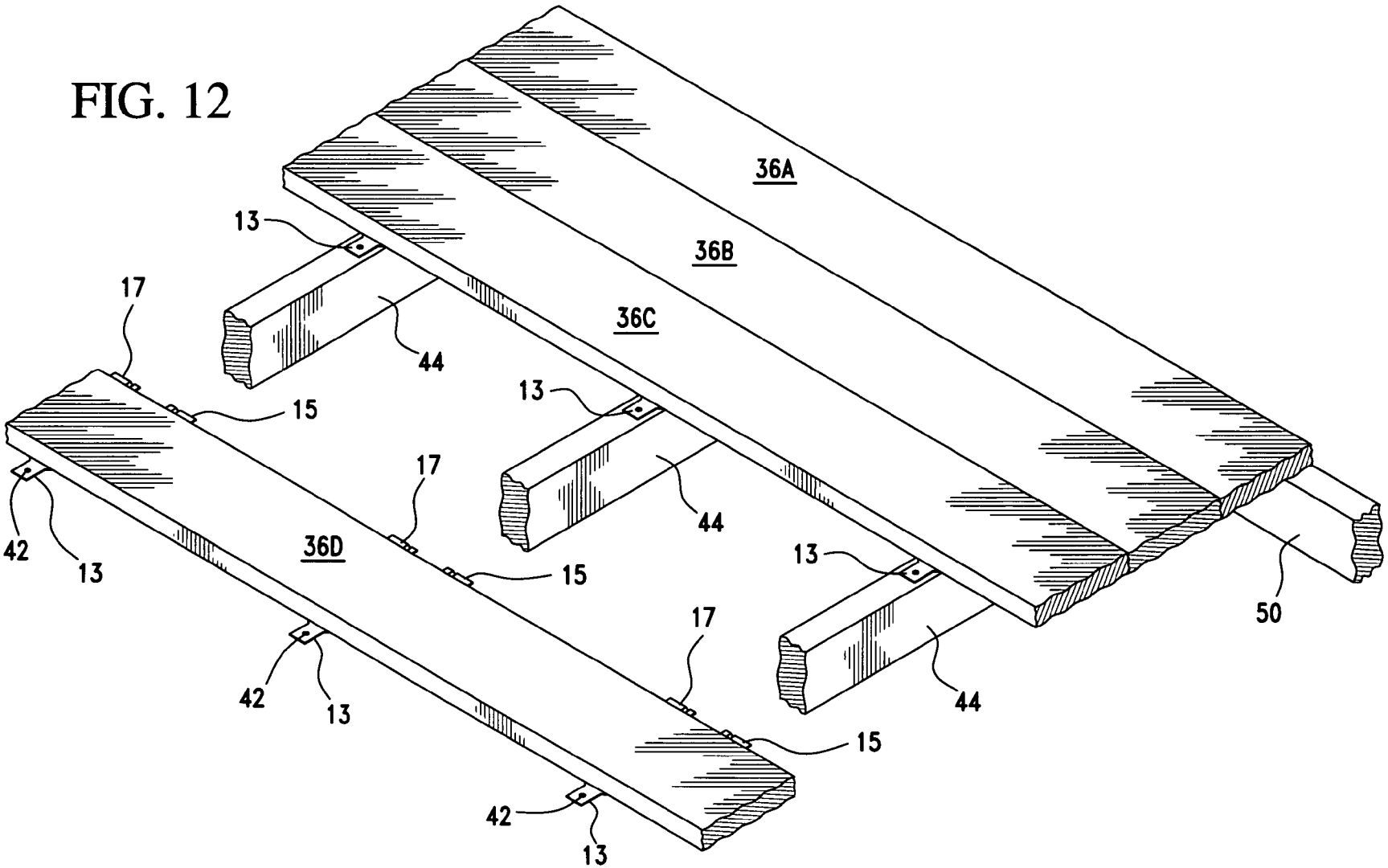
FIG. 12 is a top perspective view of FIG. 11.

As best shown in FIGS. 7-9, the boards 36 (A-E . . . ) are typically laid out from an end supporting member 50. The first board 36A is placed crosswise over the supporting member 44 and generally parallel to the end supporting member 50. The tail sections 15 and 17 of the brackets B attached to the first board 36A are bent downwardly to be mounted by screws 40 to the end surface 47 of the supporting member 50. The brackets B attached to the first board 36A are then attached to the transversely extending supporting member 44 by driving a screw 40 through the nose hole 42 (FIG. 10). (It is noted herewith that the screws in nose holes 42 of the brackets B in first and second boards 36A and 36B cannot be seen due to the succeeding overlying boards 36B and 36C.)

The second board 36B is then placed generally parallel to the first board 36A by first interlocking or tucking in the cut-outs 22 and 24 under the shoulder sections 18 and 20 of the bracket B on the previously installed board 36A (FIG. 8). In other words, the second board 36B is oriented at an angle to the first board 36A, such that the cut-out sections 22 and 24 are slid under the shoulder sections 18 and 20, respectively, of the bracket B on the board 36A. In this manner, when the second board 36B is then gently allowed to drop on the underlying supporting member 44, the rear section 16 of the bracket B on the board 36B is interlocked with the front section 12 of the first board 36A (FIG. 9). A screw 40 is then driven through the nose hole 42 in the nose section 13 of the second board 36B. The same steps are followed for the third board 36C. This procedure is repeated until all of the desired boards 36 have been overlaid the supporting members 44. In this manner, each board 36 is interlocked with the adjacent boards and attached to the supporting members 44 by the brackets B. As can be seen from FIGS. 11-12, no nails or screws are visible on the top of the boards 36.

It is noted herewith that it is preferred that at least the holes 38 and 42 be flat, and not countersunk. As a result, the screw heads protrude above (or below) the bracket surfaces. As best shown in FIG. 10, this arrangement creates a clearance C between the boards 36 and the supporting member 44, allowing air circulation. This keeps the area dry and prevents undesirable accumulation of moisture, ice, snow, etc., thereby retarding or eliminating warping, shrinking, splintering or other adverse effects.

FIGS. 4 and 6 illustrate attaching a bracket B to join two boards 36 in an end-to-end relationship. As shown, the ends 37 of the boards 36 are placed in an abutting relationship relative to the mid-section 14 of the bracket B. Two screws 40 are then driven through the two back holes 38 and the front holes 46.

From the above, it can be observed that the bracket B of the invention allows easy building of a structure, such as a deck, from the above, where the screw heads are not externally visible. In addition, since the brackets interlock directly with each other, a sturdy and more durable structure is produced. Finally, not only the screw heads remain hidden, they allow free circulation of air between the spanning members, thereby eliminating buildup of any moisture, snow, ice, etc.

While this invention has been described as having preferred sequences, ranges, steps, materials, structures, features, components, or designs, it is understood that it is capable of further modifications, uses and/or adaptations of the invention following in general the principle of the invention, and including such departures from the present disclosure as those come within the known or customary practice in the art to which the invention pertains, and as may be applied to the central features hereinbefore set forth, and fall within the scope of the invention and of the limits of the appended claims.

What is claimed is:

1. A substantially uniplanar, non-channel shaped bracket for joining at least two spanning members, comprising:

a) a substantially planar unitary body including first and second end sections, and a mid-section;

b) one of said first and second end sections including laterally spaced tail sections co-planar with said body;

c) a guide member disposed about a line extending between said tail sections and including a portion oriented out of plane with said body for aligning a spanning member relative to the bracket;

d) first and second locking members; and e) wherein the first locking member of one bracket interlocks with the second locking member of an adjacent second bracket.

2. The bracket of claim 1, wherein:

a) said first locking member comprises an angled shoulder section; and b) said second locking member comprises a cut-out section to interlock with said shoulder section.

3. The bracket of claim 2, comprising:

a) two of said laterally spaced shoulder sections; and b) two of said laterally spaced cut-out sections to interlock with the corresponding shoulder sections.

4. The bracket of claim 2, wherein:

a) said shoulder section extends at an angle of about 30°-60°.

5. The bracket of claim 2, wherein:

a) said shoulder section extends at an angle of about 45°.

6. The bracket of claim 1, further comprising:

a) a reinforcing rib.

7. A substantially uniplanar, non-channel shaped bracket for joining a plurality of spanning members to at least one supporting member running generally crosswise to at least one spanning member, comprising:

a) a generally substantially planar unitary body including front and rear sections, and a mid-section;

b) said front section including at least one shoulder section;

c) said rear section including laterally spaced tail sections co-planar with said body and at least one cut-out section;

d) said mid-section for attaching to a spanning member and said front section for attaching to a supporting member;

e) a guide member disposed about a line extending between said tail sections and including a portion oriented out of plane with said body for aligning a spanning member crosswise relative to said mid-section; and f) wherein when two spanning members are placed adjacent to each other, the cut-out section of a bracket attached to one spanning member interlocks with the shoulder section of another bracket attached to the adjacent spanning member.

8. The bracket of claim 7, wherein:

a) said front section includes left and right laterally spaced shoulder sections; and b) said rear section includes left and right laterally spaced cut-out sections.

9. The bracket of claim 7, wherein:

a) said shoulder section extends at an angle of about 30°-60°.

10. The bracket of claim 7, wherein:

a) said shoulder section extends at an angle of 45°.

11. The bracket of claim 7, wherein:

a) said mid-section includes a plurality of holes for attaching to a spanning member by driving fasteners therethrough.

12. The bracket of claim 11, wherein:

a) said front section includes at least one hole for attaching to a supporting member by driving a fastener therethrough.

13. The bracket of claim 7, wherein:

a) said rear section is wider than said front section.

14. The bracket of claim 8, further comprising:

a) a reinforcing rib.

15. An assembled structure, comprising:

a) a plurality of spanning members arranged in succession and joined by a plurality of brackets to at least one supporting member running generally crosswise to at least one spanning member;

b) each of said spanning members including upper and lower, and front and rear surfaces;

c) said supporting member including upper and lower, and left and right surfaces;

d) each of said brackets being substantially uniplanar, non-channel shaped and including a substantially planar unitary body, front and rear sections and a mid-section, said rear section including laterally spaced tail sections co-planar with said body, and each bracket including a guide member disposed about a line extending between said tail sections and including a portion oriented out of plane with said body;

e) each of said spanning members including at least one said bracket attached to the lower surface thereof in a manner that the front section thereof is adjacent the rear surface of the succeeding spanning member;

f) said brackets are generally axially oriented along the length of said supporting member; and g) wherein the rear section of one bracket engages the front section of the preceding bracket.

16. The structure of claim 15, wherein:

a) the front section of each bracket includes at least one shoulder section; and b) the rear section of each bracket includes at least one cut-out section.

17. The structure of claim 16, wherein:

a) the shoulder section interlockingly engages the cut-out section.

18. A method of joining a plurality of spanning members to at least one supporting member running generally crosswise to at least one spanning member, comprising:

a) providing a plurality of brackets, each bracket being substantially uniplanar, non-channel shaped and including:

i) a substantially planar unitary body including front and rear sections and a mid-section;

ii) the rear section including laterally spaced tail sections co-planar with the body;

iii) a guide member disposed about a line extending between the tail sections and including a portion oriented out of plane with the body; and iv) the front and rear sections including first and second locking members;

b) providing a plurality of spanning members, each including upper and lower, and front and rear surfaces;

c) providing at least one supporting member including upper and lower, and left and right surfaces;

d) attaching a first bracket to a first spanning member on the bottom surface thereof in a manner that the front section of the first bracket is adjacent the front surface thereof;

e) attaching a second bracket to a second spanning member on the bottom surface thereof in a manner that the front section of the second bracket is adjacent the front surface thereof;

f) placing the first spanning member generally crosswise relative to the supporting member and attaching the front section of the first bracket to the supporting member;

g) placing the second spanning member generally crosswise relative to the supporting member and ahead of the first spanning member; and h) interlocking the first locking member of the first bracket with the second locking member of the second bracket.

19. The method of claim 18, further comprising:

i) providing a plurality of the support members in a side-by-side relationship;

j) attaching a plurality of the brackets side-by-side along the length of each of the spanning members; and k) placing the spanning members one-by-one in succession generally crosswise on the support members such that the brackets of one spanning member are generally axially aligned with the previous spanning member.

20. The method of claim 18, wherein:

the step h) comprised tucking the second locking member under the first locking member.

21. The bracket of claim 1, wherein:

a) said mid-section includes a plurality of holes for joining at least two spanning members by driving fasteners therethrough.

22. The bracket of claim 21, wherein:

a) one of the holes is adjacent said first end section; and b) two of the holes are adjacent said second section.

23. The bracket of claim 2, wherein:

a) said first and second locking members are interlocked by tucking said cut-out section under said shoulder section.

24. The structure of claim 15, wherein:

a) the structure includes a clearance between at least one of said spanning members and said one supporting member created by a portion of at least one fastener operably engaging one of said brackets.

* * * * *